US010018450B2

(12) United States Patent
Loetz, Jr. et al.

(10) Patent No.: US 10,018,450 B2
(45) Date of Patent: Jul. 10, 2018

(54) AUTOMATED TARGET SYSTEM

(71) Applicant: TACTICAL TREE HUGGING ENTERPRISES, LLC, Oak Park, CA (US)

(72) Inventors: Ronald G. Loetz, Jr., Oak Park, CA (US); Lance D. Quevillon, Fairfield, CA (US); Michael Fineberg, Santa Clarita, CA (US); Martin Dalgaard, Topanga, CA (US); Nikolas Francis, Spring, TX (US); James Ibon, Porter Ranch, CA (US)

(73) Assignee: Tactical Tree Hugging Enterprises, LLC, Oak Park, CA (US)

( * ) Notice: Subject to any disclaimer, the term of this patent is extended or adjusted under 35 U.S.C. 154(b) by 0 days.

(21) Appl. No.: 15/418,449

(22) Filed: Jan. 27, 2017

(65) Prior Publication Data

US 2017/0219320 A1 Aug. 3, 2017

Related U.S. Application Data

(60) Provisional application No. 62/289,069, filed on Jan. 29, 2016.

(51) Int. Cl.

| | |
|---|---|
| ***F41J 5/04*** | (2006.01) |
| ***F41J 7/04*** | (2006.01) |
| ***F41J 7/06*** | (2006.01) |
| ***F41J 2/00*** | (2006.01) |
| ***F41J 5/14*** | (2006.01) |
| *F41J 5/056* | (2006.01) |

(52) U.S. Cl.
CPC . *F41J 7/06* (2013.01); *F41J 2/00* (2013.01); *F41J 5/04* (2013.01); *F41J 5/14* (2013.01); *F41J 5/056* (2013.01); *F41J 7/04* (2013.01)

(58) Field of Classification Search
CPC ..... F41J 7/04; F41J 5/04; F41J 5/056
USPC ..... 273/390–392, 406, 407
See application file for complete search history.

(56) References Cited

U.S. PATENT DOCUMENTS

| | | | | |
|---|---|---|---|---|
| 5,695,196 A * | 12/1997 | Yanosky | ..... | F41J 7/04 273/392 |
| 6,398,215 B1 * | 6/2002 | Carroll | ..... | F41J 1/10 273/108 |
| 6,994,349 B2 * | 2/2006 | Lambert | ..... | F41J 7/04 273/392 |

(Continued)

*Primary Examiner* — Mark Graham
(74) *Attorney, Agent, or Firm* — Nelson Mullins Riley & Scarborough LLP

(57) ABSTRACT

Example systems, devices, and methods related to an automated target system are provided. In this regard, a target pod device, that may be installed in a target base is provided. The target pod device may include a hinge, a target paddle, a rotary actuator, a sensor, and a processor. The target paddle may be operably coupled to the hinge and the rotary actuator may be operably coupled to the target paddle. The rotary actuator may be configured to rotate the target paddle to a deployed position or a retracted position. The sensor may detect that the target paddle has been moved toward the retracted position. The processor may be configured to transmit a signal to the rotary actuator to cause the rotary actuator to rotate the target paddle, and determine whether the target paddle has been moved toward the retracted position by a projectile.

14 Claims, 7 Drawing Sheets

(56) References Cited

U.S. PATENT DOCUMENTS

| | | | | |
|---|---|---|---|---|
| 7,690,656 | B2 * | 4/2010 | Saunders | F41J 7/04 273/392 |
| 7,694,973 | B1 * | 4/2010 | Hofmeister | F41J 7/06 273/391 |
| 8,047,546 | B1 * | 11/2011 | Klein | F41J 7/06 273/392 |
| 9,163,912 | B1 * | 10/2015 | Stark | F41J 1/10 |
| 9,612,092 | B2 * | 4/2017 | Chester | F41J 7/04 |
| 2012/0043722 | A1 * | 2/2012 | Mironichev | F41J 7/04 273/406 |
| 2015/0102563 | A1 * | 4/2015 | Gwash | F41J 7/06 273/390 |
| 2015/0260487 | A1 * | 9/2015 | Steil | F41J 7/04 273/390 |
| 2015/0292843 | A1 * | 10/2015 | Burtan | F41J 1/10 273/391 |
| 2016/0195369 | A1 * | 7/2016 | Perry | F41J 7/04 434/19 |
| 2017/0059288 | A1 * | 3/2017 | Campbell | F41J 7/04 |

* cited by examiner

AUTOMATED TARGET SYSTEM

CROSS REFERENCE TO RELATED APPLICATIONS

This application claims the benefit of U.S. Provisional Application No. 62/289,069 filed on Jan. 29, 2016, the entire contents of which are hereby incorporated herein by reference.

FIELD OF THE INVENTION

Embodiments of the present invention relate generally to training and gaming technologies and, more particularly, to systems and devices for projectile target training and gaming.

BACKGROUND OF THE INVENTION

Devices that launch projectiles (e.g., guns, bows, artillery, or the like) require a keen level of skill, typically develop through repeated practice, to be used effectively. Projectile launching devices are used in a variety of settings such as for hunting, for protection, for gaming, or the like. Often, users of these devices practice at, for example, practice ranges where projectile launching devices can be used repeatedly to hone a user's targeting ability and skill. Conventional target practice systems suffer from a number of drawbacks that make use of them inefficient and cumbersome. As such, there is demand for innovation in the target practice and training technology area.

BRIEF SUMMARY OF THE INVENTION

According to some example embodiments, a target training system is provided. The target training system may comprise a target base and a plurality of target pod devices. The target base may comprise a frame, a shroud, a target base processor, and a target base communications interface. The shroud may be supported by the frame and the shroud may include attachment positions for removably attaching each of the target pod devices to the target base. The target base processor may be configured to implement a target training game that controls operation of the target pod devices. The target base communications interface may be configured to support communications between the target base processor and each of the target pod devices. Each of the target pod devices may comprise a pod base, a hinge, a target paddle, a rotary actuator, a sensor, a target pod processor and a target pod communication interface. In this regard, the target paddle may be operably coupled to the pod base by the hinge and the target paddle may be configured to swivel between a deployed position and a retracted position. The rotary actuator may be operably coupled to the target paddle and configured to receive an actuator signal. Based on the actuator signal, the rotary actuator may be configured to rotate the target paddle to the deployed position or the retracted position. The sensor may be configured to detect that the target paddle has moved towards the retracted position and provide a sensor signal indicating whether the target paddle has moved toward the retracted position. The target pod processor may be configured to transmit the actuator signal to the rotary actuator to cause the rotary actuator to rotate the target paddle into the deployed position based on the target training game, and determine, based on the sensor signal, whether the target paddle has been moved toward the retracted position by a projectile.

The a target pod communications interface may be configured to support communications between the target pod processor and the target base.

According to some example embodiments, a target pod device is provided. The target pod device may comprise a pod base, a hinge, a target paddle, a rotary actuator, and a processor. The target paddle may be operably coupled to the pod base by the hinge. The target paddle may be configured to swivel between a deployed position and a retracted position. The rotary actuator may be operably coupled to the target paddle, and the rotary actuator may be configured to receive an actuator signal and, based on the actuator signal, rotate the target paddle to the deployed position or the retracted position. The sensor may be configured to detect that the target paddle has been moved toward the retracted position and provide a sensor signal indicating whether the target paddle has been moved toward the retracted position. The processor may be configured to transmit the actuator signal to the rotary actuator to cause the rotary actuator to rotate the target paddle into the deployed position, and determine, based on the sensor signal, whether the target paddle has been moved toward the retracted position by a projectile.

BRIEF DESCRIPTION OF THE DRAWINGS

Figure 1:
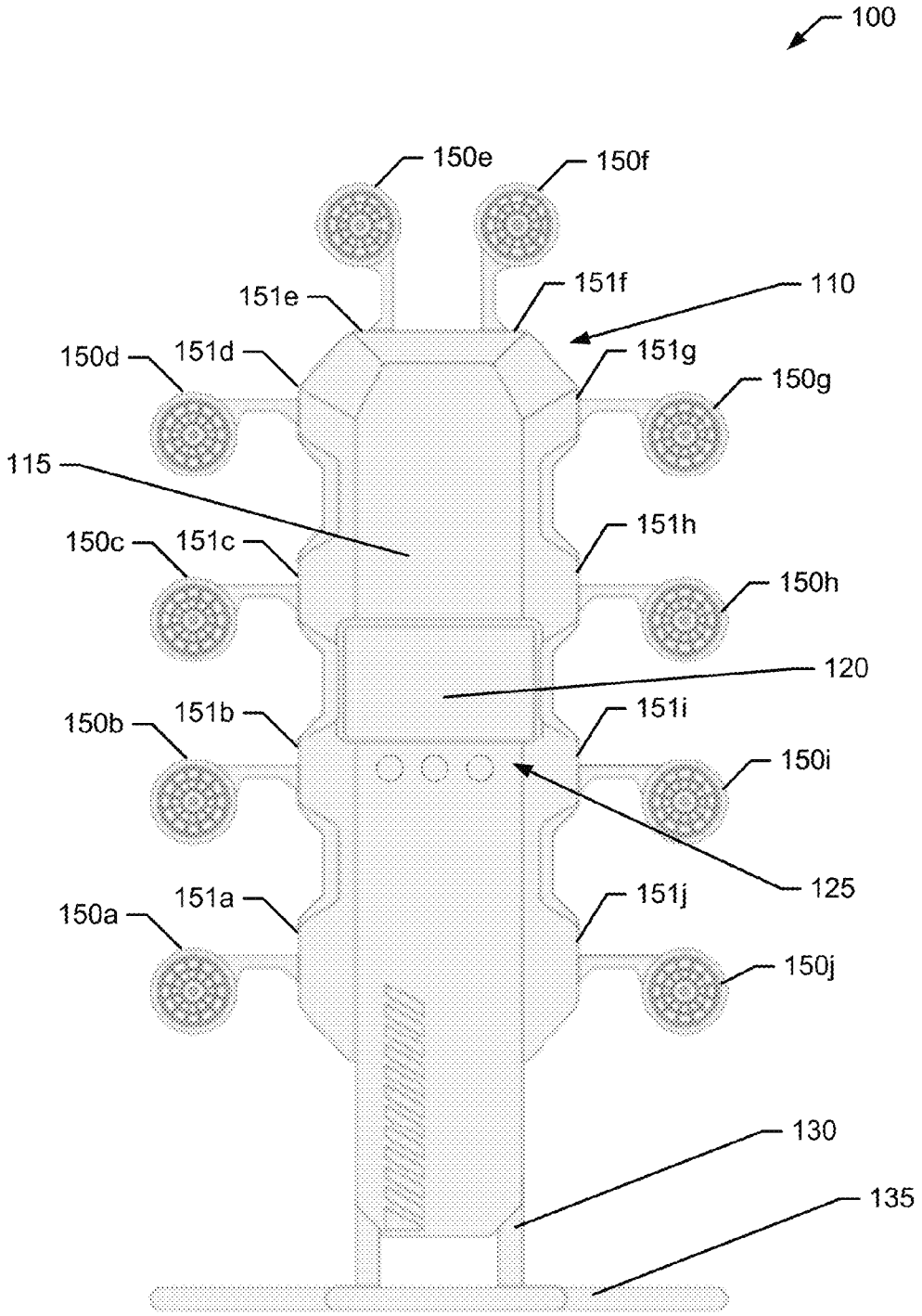
Figure 2:
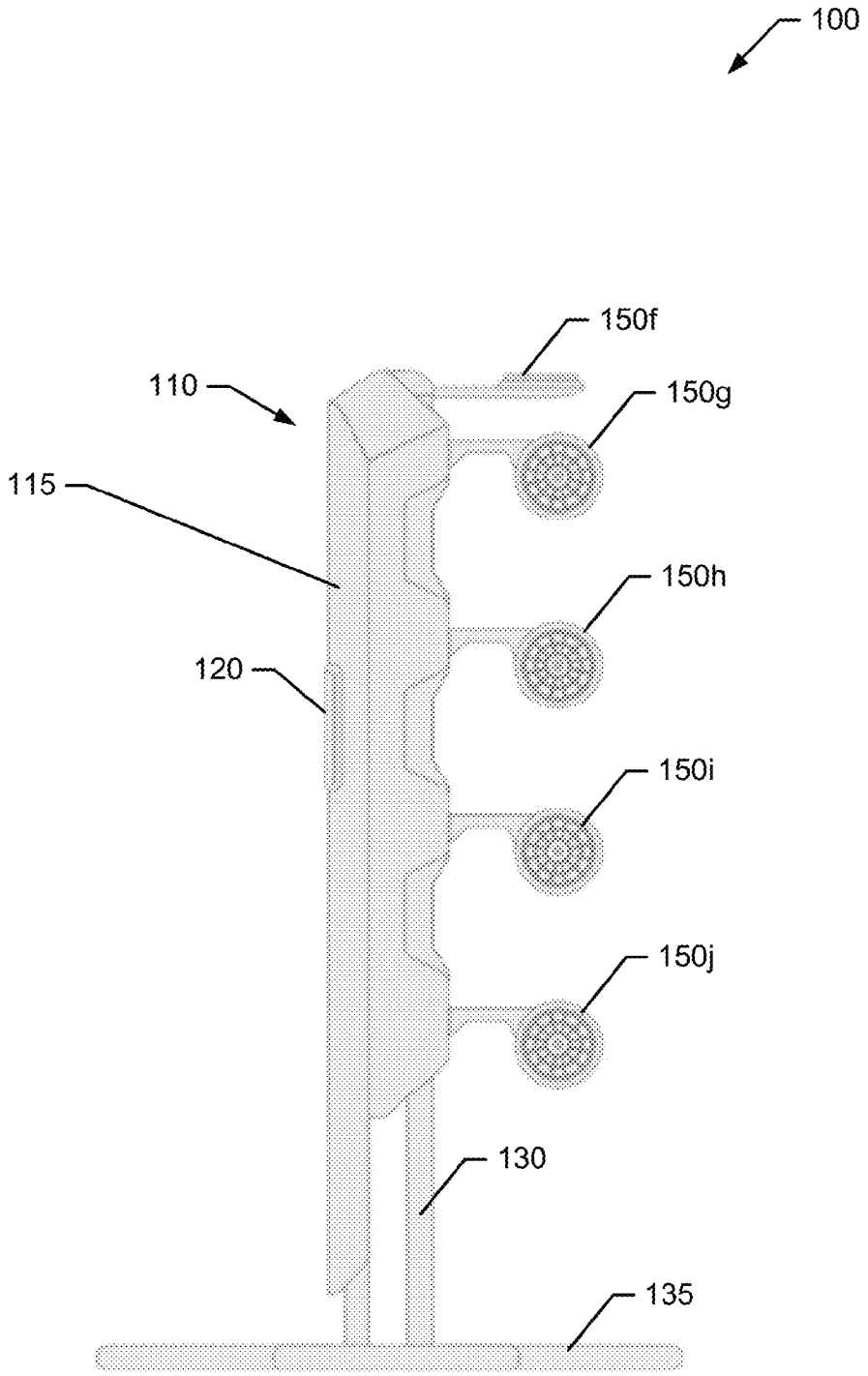
Figure 3:
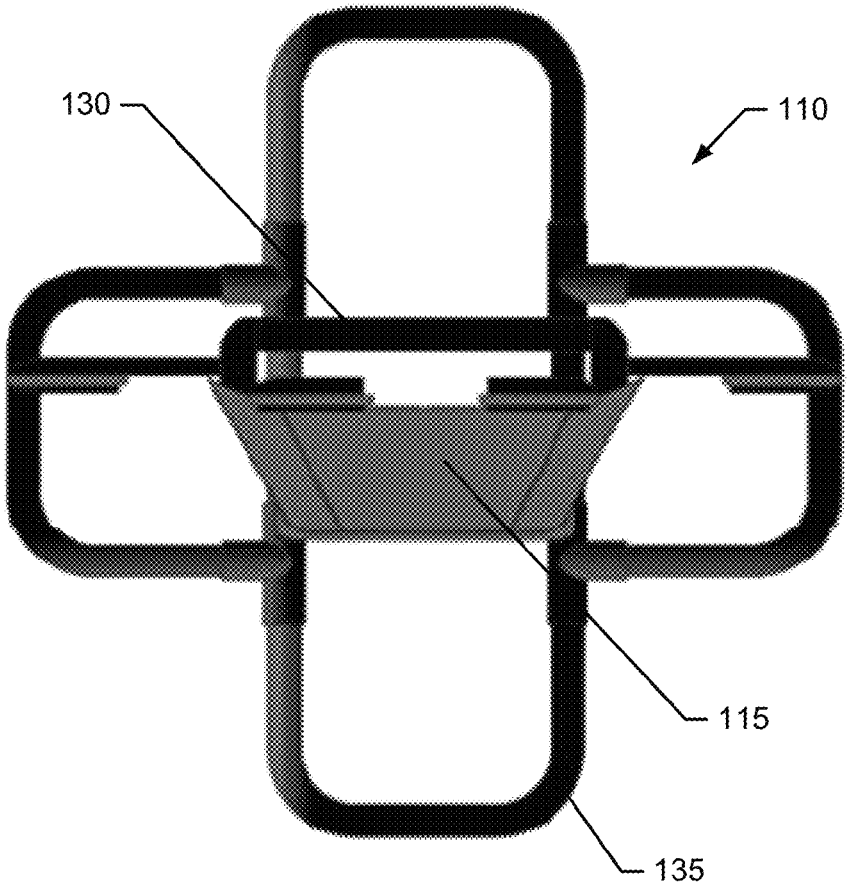
Figure 4:
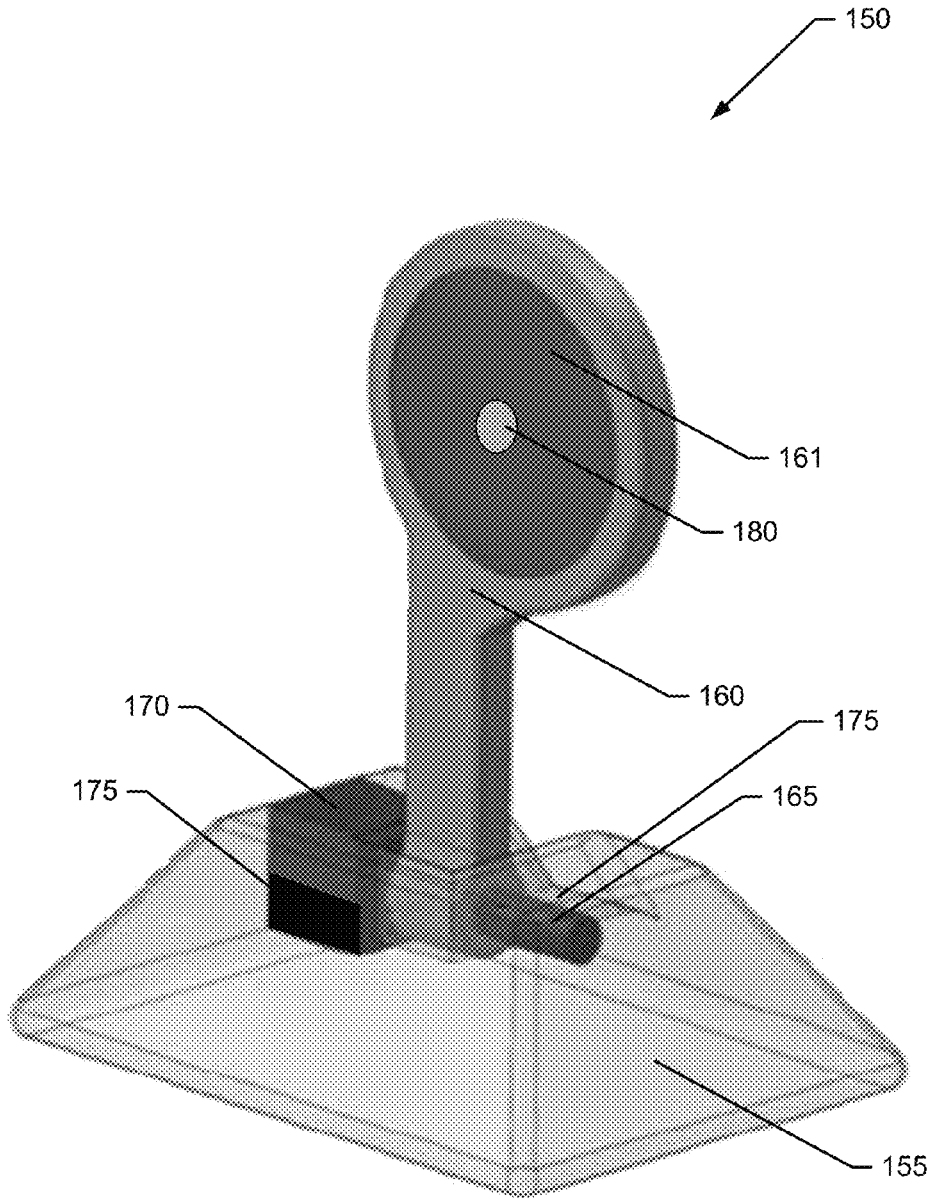
Figure 5:
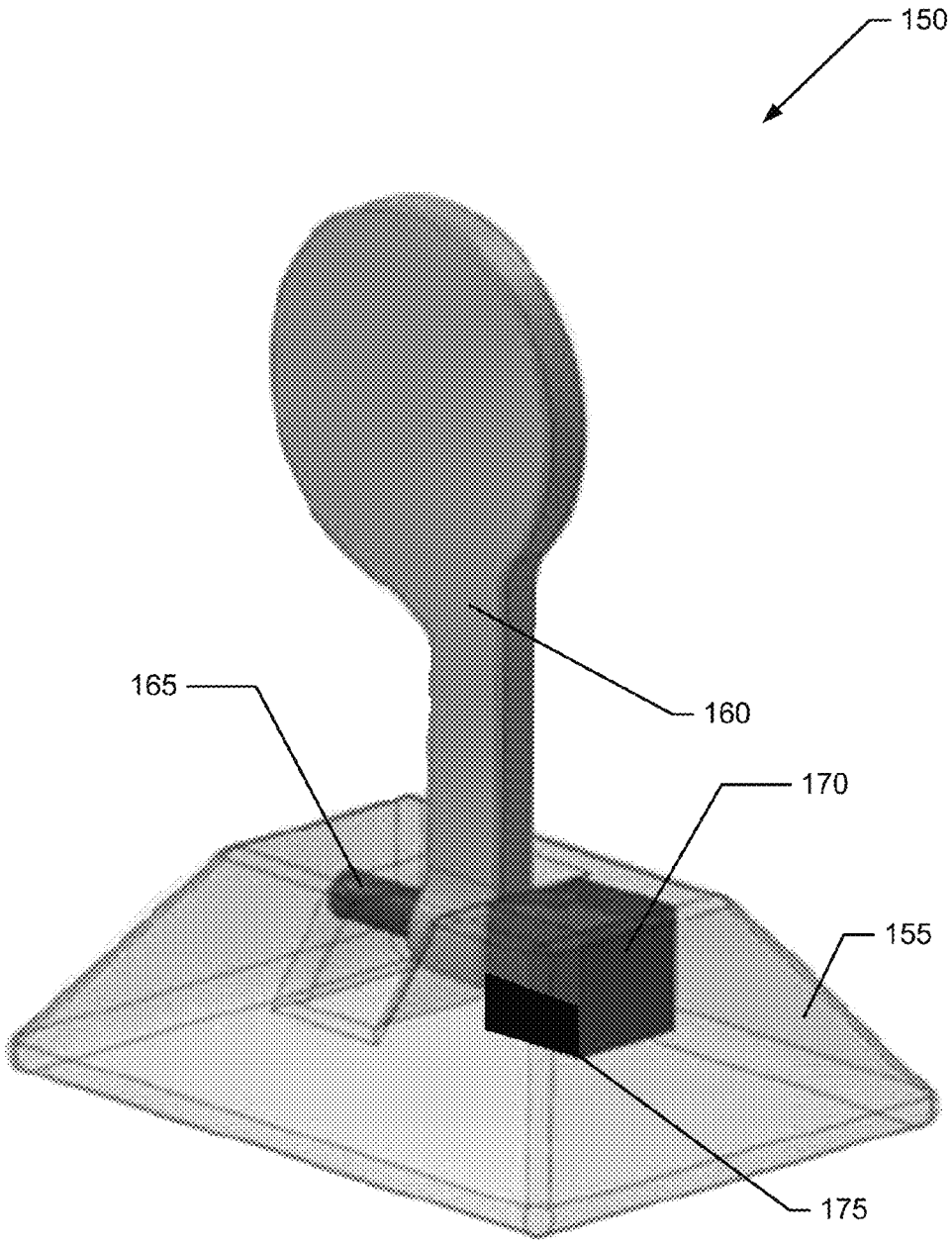
Figure 6:
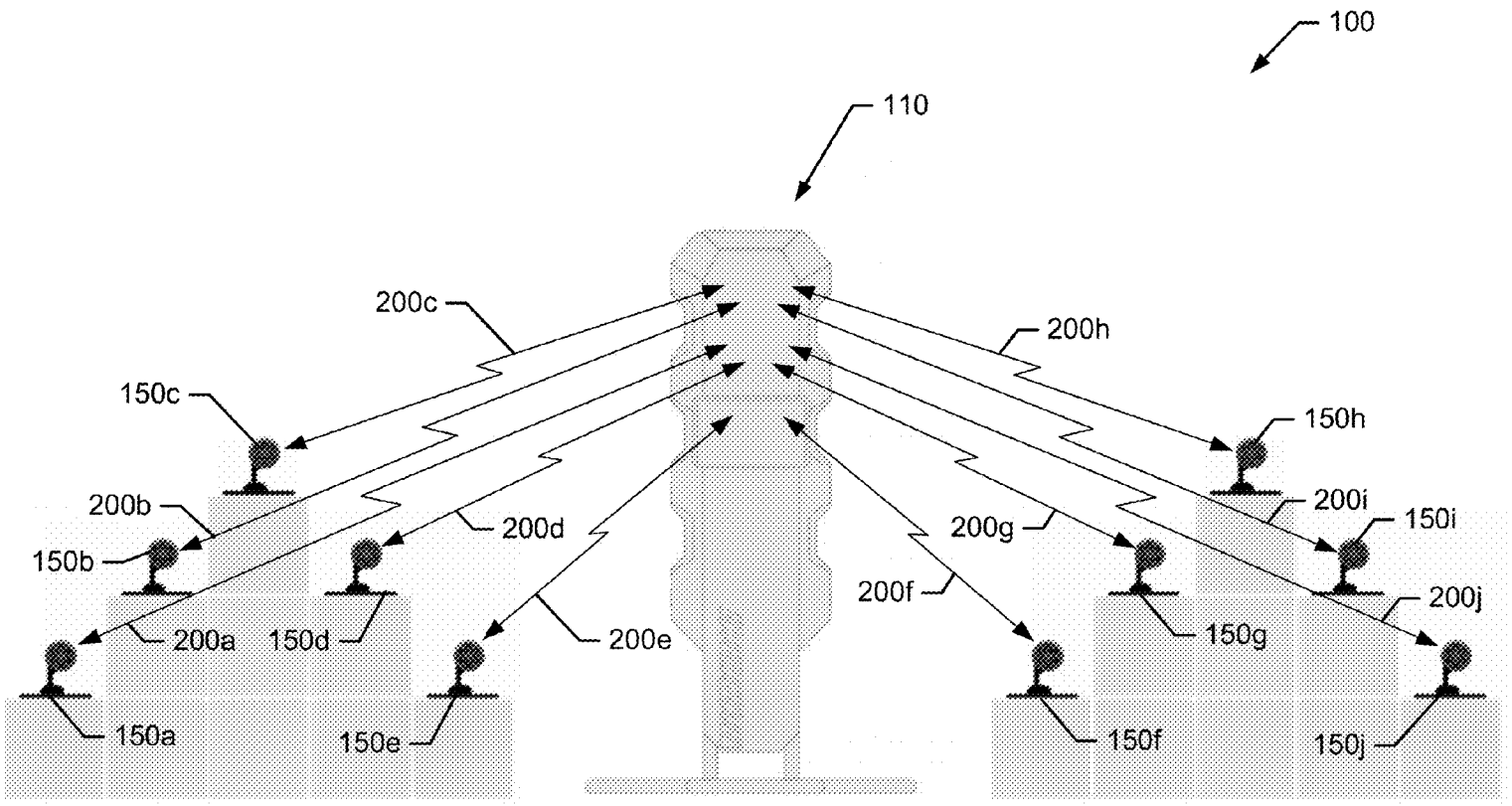
Figure 7:
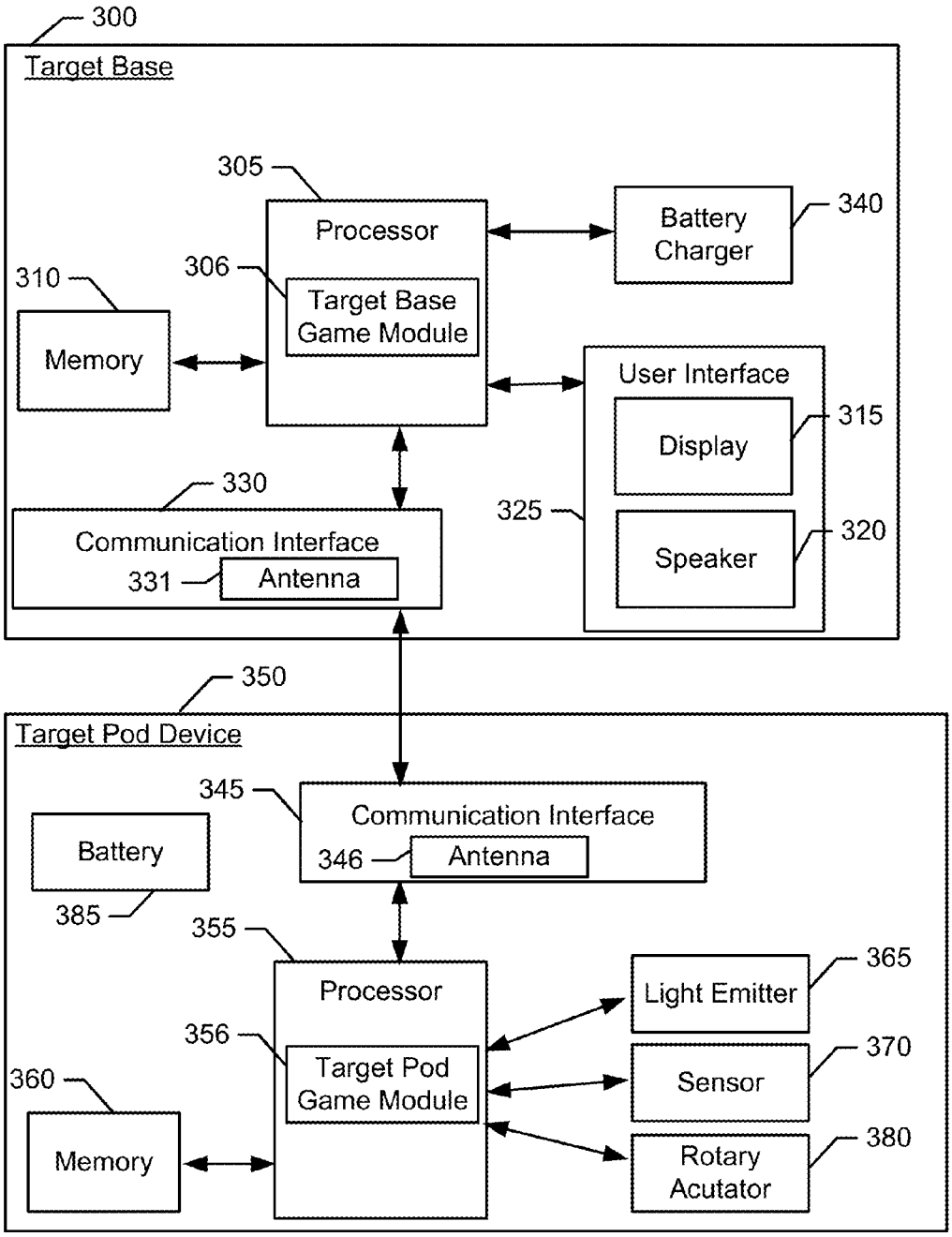

Having thus described some example embodiments in general terms, reference will now be made to the accompanying drawings, which are not necessarily drawn to scale, and wherein:

FIG. 1 shows a front view of an example target training system in accordance with some example embodiments;

FIG. 2 shows a side view of an example target training system in accordance with some example embodiments;

FIG. 3 shows a top view of an example target training system in accordance with some example embodiments;

FIG. 4 shows a front view of an example target pod device in accordance with some example embodiments;

FIG. 5 shows a back view of an example target pod device in accordance with some example embodiments;

FIG. 6 shows an example target training system in a remote configuration in accordance with some example embodiments; and FIG. 7 shows a block diagram of example electronics and operable connections between elements of an example target training system in accordance with some example embodiments.

DETAILED DESCRIPTION

Exemplary embodiments will be described more fully hereinafter with reference to the accompanying drawings, in which some, but not all embodiments of the invention are shown. Indeed, the embodiments take many different forms and should not be construed as being limiting. Rather, these example embodiments are provided so that this disclosure will satisfy applicable legal requirements. Like reference numerals refer to like elements throughout.

Example embodiments of the present invention relate to target training technologies that are automated and easy to use. According to some example embodiments, a target training system may include a target base and a plurality of target pod devices. The target pod devices may include the targets that are to be aimed at by a user in an effort to hit the target with a projectile. The targets may be movable in response to being hit by a projectile and the target pod devices may be equipped to detect a hit, and automatically reset or move the target back into a deployed position. The target pod devices may can be installed in the target base and used in a local configuration, or the target pod devices may be removed from the target base and placed remote from the base and used in a remote configuration. In this regard, according to some example embodiments, the target pod devices may be equipped to wirelessly communicate with the target base to communicate hit information back to the target base for tracking and scoring. Further, the target base may be configured to implement one of a variety of games selected by a user via a local or remote user interface, and based on the selected game, the target base may communicate with the target pod devices to control operation of the target pod devices in accordance with the game.

FIG. 1. shows an example target training system 100 that includes a target base 110 and a plurality of target pod devices (i.e., target pod devices 150*a*, 150*b*, 150*c*, 150*d*, 150*e*, 150*f*, 150*g*, 150*h*, 150*i*, and 150*j*). The target base 110 may include a shroud 115, and a frame 130. According to some example embodiments, the target base 110 may also include a display 120, a user interface 125, and a stand 135. The target base 110 may also include internal electronics, such as a processor and a communications interface as described herein and with respect to FIG. 7.

The shroud 115 may be comprised of any type of rigid or semi-rigid material, such as, for example, thermoformed plastic. The shroud 115 may operate to house, and possibly protect, various internal electronic and mechanical components of the target base 110. The shroud 115 may be supported by the frame 130, which, according to some example embodiments, may be comprised of tubular steel. The frame 130 may be supported by the stand 135, which may also be comprised of tubular steel.

The shroud 115 may include attachment positions 151*a*, 151*b*, 151*c*, 151*d*, 151*e*, 151*f*, 151*g*, 151*h*, 151*i*, and 151*j* for respective target pod devices. In this regard, the target base 110 may be designed to stow a number of target pod devices such as, for example, ten target pod devices. When the target pod devices are attached to the target base 110, the target training system 100 is referred to as being in a local configuration. When a target pod device is attached to the target base 110 at an attachment position, the target pod device may be charged by the target base 110. In this regard, the target pod device may include a rechargeable battery that is operably connected to electrical contacts on the target base 110, when the target pod device is attached at the attachment position. Further, the target base 110 may include a battery or be mains powered and the target base battery or the mains power may be utilized to charge the batteries of the target pod devices.

The target pod devices may be configured (e.g., via the shape of the target pod devices and the shape of the attachment positions, via hooks or other connectors between the target pod devices and the target base, or the like) to be removable from the target base 110 and placed at remote locations some distance from the target base 110. When the target pod devices are removed from the target base 110 and located remote from the target base 110, the target training system 100 is referred to as being in the remote configuration.

The shroud 115 may house the user interface 125, which may include the display 120, a speaker, buttons, nobs, or the like. According to some example embodiments, the user interface 125 or another user interface may be located remote from the target base 110 in the form of application on, for example, a smart phone or tablet that communicates user input and feedback via wireless communication with the target base 110. The user interface 125 may be configured to receive user input to, for example, select one of plurality of target training games that may be implemented by the target training system 100. The display 120 may visually present various user selections that can be selected by the user via a touch screen interface, buttons, nobs, or the like. According to some example embodiments, the display 120 may be an LCD display. The display 120 may also provide a user with game related feedback information such as scoring, and game instructions. A speaker of the user interface may provide audible feedback to the user, for example, in relation to making a target training game selection or during the process of a game in response to, for example, detections of one or more hits of the targets or completion of the game.

In FIG. 1, the targets of the target pod devices are shown in a deployed position. In the deployed position, as further described below, a projectile may contact the target and force the target into or towards a retracted position when the target is hit. The position of the target may be controlled by electronics in the target pod devices and an electro-mechanical actuator. In this regard, based on the selected target training game or detected movement of the target, the electronics of the target pod device may instruct the rotary actuator to rotate the targets into the deployed or retracted position. FIG. 2 shows a side view of the target training system 100 with the targets of target pod devices 150*f*, 150*g*, 150*h*, 150*i*, and 150*j* disposed in retracted positions.

FIG. 3 shows a top view of the target base 110 where the interaction between the frame 130 and the shroud 115 is also shown. Further, an example design of the stand 135 can also be seen where an example cross shape has been utilized. It is understood, however, that the stand 135 may take any shape (e.g., a circular shape) that may be capable of supporting the frame 130 and the target base 110.

FIGS. 4 and 5 show an example embodiment of a target pod device 150. FIG. 4 shows a front view of the target pod device 150 and FIG. 5 shows a back view of the target pod device 150. As described above, the target pod device 150 may be removable from the target base 110 to operate remotely, while in communication with the target base 110. The target pod device 150 may comprise a pod base 155, a hinge 165, a target paddle 160, a rotary actuator 170, and a sensor 175. In general, the target pod device 150 may be configured to deploy and detect movement or deflection of a target caused by a projectile hitting the target. Further, the target pod device 150 is also configured to send communications to and receive communications from the target base 110 based the detection of a target hit, a no target hit event, or other events relating to a selected target training game. The various mechanical and electrical components of the target pod device 150 described herein operate to facilitate these and other functionalities of the target pod device 150. Accordingly, the target pod device 150 may also include internal electronics, such as a processor and a communications interface as described herein and with respect to FIG. 7.

The target paddle 160 and the target base 155 may be comprised of, for example, thermoformed plastic or another rigid or semi-rigid material. The hinge 165 may also be comprised of, for example, thermoformed plastic but other materials such as, for example, aluminum or other metals may be used. The hinge 165, the rotary actuator 170, and the sensor 175 may be housed in the pod base 155. The target paddle 160 may be operably coupled to the hinge 165 and may extend away from the pod base 155.

The target paddle 160 may include an attachment end that is operably coupled to the hinge 165, a target end that includes target area 161, and an arm disposed there between. According to some example embodiments, the target area 161 of the target paddle 160 may be wider than the attachment end, and the target area 161 may have, for example, a three inch diameter. The attachment end may include a connector for connecting the target paddle 160 to the hinge 165. The connector may be, for example, a cylindrical orifice that the receives and engages the hinge 165, which may take the form of a cylinder or post. The cylindrical orifice of the target paddle 160 may be press fit onto the hinge 165, or the orifice may include teeth and the hinge 165 may include recesses that marry as the target paddle 160 is slid onto the hinge 165. Accordingly, the target paddle 160 may be operably coupled to the pod base 155 by the hinge 165, and the target paddle 160 may be configured to swivel between the deployed position and the retracted position.

According to some example embodiments, the target paddle 160 may include a light emitter 180, in the form of an LED or other light device. The light emitter 180 may be configured to produce one or more light colors (e.g., red, green, etc.). Based on a selected target training game, a processor of the target pod device 150 may be configured to instruct the light emitter 180 to produce selected colors.

The hinge 165 may be rotated by the rotary actuator 170, thereby rotating the target paddle 160. In this regard, the rotary actuator 170 may be instructed by, for example, a processor of the target pod device 150 to rotate and place the target paddle 160 in either the deployed position (as shown in FIG. 4) or in a retracted position (if the target paddle 160 was swiveled clockwise approximately ninety degrees from the deployed position shown in FIG. 4). The rotary actuator 170 may be operably coupled to the target paddle 160. The rotary actuator 170 may be configured to receive, for example, an actuator signal and, based on the actuator signal, rotate the target paddle 160 to the deployed position or the retracted position. The rotary actuator 170 may be any type of electromechanical actuator that can either solely or in conjunction with other components (e.g., gears) to create rotary motion to swivel the target paddle 160. According to some example embodiments, the rotary actuator 170 may be a rotary solenoid.

Further, the mechanism including the rotary actuator 170, the hinge 165, and the target paddle 160 may also be configured to hold in the deployed position but also permit the target paddle 160 to rotate or slip from the deployed position towards the retracted position in response to a force that is applied by the impact of projectile on the target area 161 of the target paddle 160. In this regard, hinge 165 may be a friction hinge that requires a threshold amount of the starting force to move the hinge from the deployed position. As such, the rotary actuator 170 may be capable of supplying sufficient starting force to move the hinge 165 and the target paddle 160, but once the hinge 165 is moved in the desired position (e.g., the deployed position or retracted position), the rotary actuator 170 may no longer supply a force to maintain the position of the hinge 165. Accordingly, the friction of the hinge 165 may be the mechanism that holds the hinge 165 (and thereby the target paddle 160) in a current position. With the rotary actuator 170 no longer providing a force to the hinge 165, according to some example embodiments, a projectile that impacts the target area 161 needs to impact with sufficient force to overcome the starting friction of the hinge 165 to rotate the target paddle 160 from the deployed position towards the retracted position.

The target pod device 150 may also include a sensor 175. According to some example embodiments, the sensor 175 may be an accelerometer. According to some example embodiments, the sensor 175 may alternatively be a potentiometer or a switch that may be used to detect a position of the target paddle 160. The sensor 175 may be configured to detect that the target paddle 160 has moved (i.e., detect motion) towards the retracted position and provide a sensor signal indicating to, for example, a processor of the target pod device 150 that the target paddle has moved toward the retracted position. Alternatively, the sensor 175 may be configured to monitor a position of the target paddle 160 and generate a sensor signal indicative of the position. Further, according to some example embodiments, the sensor 175 may be configured to detect and measure the inertia exhibited by the target paddle 160 in response to being impacted by a projectile and the sensor signal may be generated based on the detection of the inertia.

FIG. 6 shows the target training system 100 in the remote configuration where the target pod devices 150*a*, 150*b*, 150*c*, 150*d*, 150*e*, 150*f*, 150*g*, 150*h*, 150*i*, and 150*j* have been removed from and are located remote from the target base 110. In this regard, despite the distance between the target pod devices and the target base 110, the target pod devices may remain in communication with the target base 110. Further, the communications between the target pod devices and the target base 110 may be wireless communications that take place on a wireless channel. Accordingly, each target pod device may establish a respective communication channel connection 200*a*, 200*b*, 200*c*, 200*d*, 200*e*, 200*f*, 200*g*, 200*h*, 200*i*, and 200*j* with the target base 110. Via the communications channel connections, a target training game may be implemented by the target training system 100 while the target training system 100 is in the remote configuration.

FIG. 7 shows a block diagram of some example electronics that may be included in a target training system that includes a target base 300 and a target pod device 350. It is understood that target pod device 350 may be one example of a plurality of target pod devices that may be included in a target training system. The target base 300 may be the same or similar to the target base 110 described above or otherwise herein. The target pod device 350 may be the same or similar to the target pod device 150 described above or otherwise herein. Because the target base 300 and the target pod device 350 can operate as a system, it is contemplated that while certain components and functionalities of components may be shown and described as being part of the target base 300 or the target pod device 350, according to some example embodiments, some components may be included in the other of target base 300 or the target pod device 350 or both to perform the same or similar functionalities.

As depicted in FIG. 7, both the target base 300 and the target pod device 350 include processors, memories, and communications interfaces, which may be the same or similar between the devices. In this regard, the processors 305 and 355 may be any means configured to execute various programmed operations or instructions stored in a memory device such as a device or circuitry operating in accordance with software or otherwise embodied in hardware or a combination of hardware and software (e.g., a processor operating under software control or the processors embodied as an application specific integrated circuit (ASIC) or field programmable gate array (FPGA) specifically configured to perform the operations described herein, or a combination thereof) thereby configuring the device or circuitry to perform the corresponding functions of the processors 305 and 355 as described herein. In this regard, the processors 305 and 355 may be configured to analyze electrical signals communicated thereto, for example in the form of signals received from the communication interfaces 330 and 345, respectively, and modify operation of the target base 300 or the target pod device 350 in accordance with a target training game being implemented by a target training system. The memories 310 and 360 may be configured to store instructions, computer program code, game code, hit data, scores, and other data in a non-transitory computer readable medium for use, such as by the processors 305 and 355.

The communication interfaces 330 and 345 may be configured to enable connection to external systems (e.g., target pod device 350 or the target base 300, respectively). In this regard, the communication interface 330 may be configured to support communications between the processor 305 and each of the target pod devices, including target pod device 350. The communication interface 345 may be configured to support communications between the processor 355 and the target base 300. The communication interfaces 330 and 345 may support wireless communications via the antennas 331 and 346, respectively. Communication interfaces 330 and 345 may be configured to communicate via a number of different communication protocols and communication layers. For example, the link between the communication interface 330 and communication interface 345 may be any type of wired or wireless communication link. For example, communications between the interfaces may be conducted via WiFi, Bluetooth, ethernet, cellular, or other suitable techniques. In this regard, the communication interfaces 330 and 345 may include various RF circuitry including a radio front end and RF modulators to support wireless communications.

With respect to the specific operation of the target base 300, the processor 305 may be configured to implement a target base game module 306 to perform the various functions described herein and facilitate implementation of a target training game. Further, the processor 305 may be operably connected to and control, in accordance with the target base game module 306, a user interface 325, which may include, for example, a display 315 and a speaker 320. The user interface 325 may also include button controls and the like that may be used to for example, select a target training game. The user interface 325 may be the same or similar to the user interface 125 described above. The display 315 may be the same or similar to the display 120 described above.

Similarly, with respect to the operation of the target pod device 350, the processor 355 may be configured to implement a target pod game module 356 to perform the various functions described herein to facilitate implementation of a target training game, in conjunction with the operation of the target base 300 and the target base game module 306. Further, the processor 355 may be operably connected to a light emitter 365, a sensor 370, and a rotary actuator 380. The light emitter 365 may be the same or similar to the light emitter 180 described above. The sensor 370 may be the same or similar to the sensor 175 described above. Further, the rotary actuator 380 may be the same or similar to the rotary actuator 170 described above.

In accordance with some example embodiments, the processor 305 may be configured, via the target base game module 306, to implement a target training game and control operation of a plurality of target pod devices, including target pod device 350. Accordingly, possibly in response to communications received from the target base 300 and the processor 305, the processor 355 of the target pod device 350 may be configured to transmit an actuator signal to the rotary actuator 380 to cause the rotary actuator 380 to rotate a target paddle (e.g., target paddle 160) into the deployed position based on a selected target training game. Further, the processor 355 may be configured to determine, based on a sensor signal from the sensor 370, whether a target paddle has been moved toward the retracted position by a projectile.

With respect to interaction with the user interface 325, the processor 305 may be configured to receive user inputs and selections via the user interface 325 and provide outputs (e.g., visible and audible outputs) via the user interface 325. According to some example embodiments, the user interface 325 may be part of and disposed local to the target base 300. However, according to the some example embodiments, the user interface 325 may be remote from the target base 300 and user interface 325 may communicate with the processor 305 via the communication interface 330 and wireless communication. In this regard, the user interface 325 may be an application implemented on, for example, a smart phone or tablet that communicates to the target base 300 via, for example, Bluetooth communications.

Whether disposed locally or remotely, the display 315 may be controlled by the processor 305 to present target training game information based on a selected target training game and communications received from the target pod devices. In this regard, target training game information may include, for example, scores, aggregate target hit counts, a duration of time used to hit a threshold number of targets, or the like. Similarly, the processor 305 may also control speaker 320 to generate audible sounds based on the target training game. The audible sounds may be generated in response to a target being hit, a high score, a threshold time, or the like. Additionally or alternatively, the user interface 325 may receive user inputs that may be provided to the processor 305 to determine a user-selected target training game.

According to some example embodiments, based on the target training game, the processor 305 may be configured to aggregate hit data received from each of the target pod devices and generate a score based on the aggregated hit data. In this regard, the hit data may indicate that a respective target paddle for target pod device (e.g., target pod device 350) has been moved toward the retracted position by a projectile.

According to some example embodiments, based on the target training game, the processor 305 may be configured to start a timer, and aggregate hit data received from each of a plurality of target pod devices including target pod device 350. The processor 305 may be further configured to determine a duration of time, based on the timer, that transpired before a threshold number of target pod devices (e.g., all of the target pod devices) detected that a projectile moved a respective target paddle toward the retracted position.

According to some example embodiments, the processor 305 may be further configured to control operation of a first target pod device within the plurality of target pod devices (e.g., target pod device 350) based on hit data received from a second target pod device within the plurality of target pod devices. In this regard, the hit data may indicate that the target paddle for a respective target pod device has been moved toward the retracted position by a projectile, which may cause the first target pod device to move a target paddle into a deployed position.

With respect to the operation of the target pod device 350 and the processor 355 implementing the target pod game module 356, the processor 355 may be configured to control the light emitter 365. In this regard, the processor 355 may be configured to control the light emitter 365 to emit one of plurality of colors based on the target training game. Additionally, according to some example embodiments, the processor 355 may be configured to analyze the sensor signal provided by the sensor 370 and generate a hit indication signal in response to the sensor signal indicating that the target paddle has moved toward the retracted position by the projectile. The processor 355 may communicate the hit indication signal to the target base 300. According to some example embodiments, the processor 355 may be further configured to start a timer, and generate a no hit indication signal in response to the timer surpassing a threshold duration and the sensor signal indicating that the target paddle has remained in the deployed position. Again, the processor 355 may be configured to communicate the no hit indication signal to the target base 300.

Further, according to some example embodiments, the processor 355 may be further configured to, in response to determining that the target paddle has been moved toward the retracted position by the projectile based on the sensor signal, transmit the actuator signal to the rotary actuator 380 to cause the rotary actuator 380 to rotate the target paddle into the retracted position. In this regard, if an impact caused by a projectile is detected, the target paddle may not deflect completely back to the retracted position. However, if movement of the target paddle is detected in the direction of the retracted position, and the target paddle did not completely deflect into the retracted position, then the processor 355 may instruct the rotary actuator 380 to move the target paddle into the retracted position. In this manner, if a target is hit and not completely deflected into the retracted position, the processor 355 and the rotary actuator 380 may move the target and the target paddle into the retracted position.

According to some example embodiments, the processor 355 may be configured to receive a game signal from the target base 300 via the communication interface 345. The game signal may include an indication of a target training game that was selected by a user via the user interface 325. Based on the game signal, the processor 355 may be configured to transmit an actuator signal to the rotary actuator 380 to cause a target paddle to move in accordance with the target training game.

According to some example embodiments, the processor 355 may be further configured to start a timer, and generate a no hit event and related signal in response to the timer surpassing a threshold duration and the sensor signal indicating that the target paddle has remained in the deployed position. In this regard, a countdown may be implemented by the processor 355, and if the target paddle has not moved toward the retracted position before the countdown timer expires, then the rotary actuator 380 may rotate the target paddle into the retracted position and the processor 355 may log or communicate the no hit event.

According to some example embodiments, the target base 300 may also include a battery charger 340 that is controlled by the processor 305. In this regard, the battery charger 340 may be configured to charge the battery 385 of the target pod device 350, when the target pod device 350 is installed at an attachment position on the target base 300 (i.e., in the local configuration). The battery 385 may operate to power all of the electrical components of the target pod device 350. According to some example embodiments, when the battery 385 has a low threshold power level, as determined by the processor 355, the user may be alerted by, for example, flashing the light emitter 365. Via the user interface 325, the user may also be notified that a target pod device battery is being charged, such as, by indicating the charging on the display 315. In this regard, the battery of the target pod device may be operably connected to the battery charger 340 of target base 300 to charge the battery 385 in response to the target pod device being installed in an attachment position of the target base 300.

Using the functionalities described herein the target training system may be configured to implement various example target training games. In this regard, a first target training game may support a single individual shooter. In accordance with the single individual shooter game, the processor 305 may instruct the processors 355 of the various target pod devices 350 to move each respective target into deployed positions for one or more target pod devices in a randomly sequenced fashion. Further, some of the targets may be illuminated by a light emitter and colored in one of two colors. The game may be defined such that the user is expected to shoot only targets that are illuminated with a certain color. If a properly colored target is hit, then the user may be awarded a point. If an improperly colored target is hit, then a point may be deducted from a user's score total. If a properly colored target remains deployed for a threshold period of time (e.g., 2 or 2.5 seconds), then the target may be moved into the retracted position and a point may be deducted from the user's total due to the no hit event. A highest score or scores may be presented on a display.

A second target training game may support multiple shooters. In accordance with the multi-shooter game, the processor 305 may instruct the processors 355 of the various target pod devices 350 to move each respective target into a deployed position for one of more target pod devices in a randomly sequenced fashion. Further, the targets may be illuminated by a light emitter such that each shooter is associated with a given color. The game may be defined such that each user is expected to shoot only targets that are illuminated with their assigned color. If a properly colored target is hit, then the user may be awarded a point. If an improperly colored target is hit, then the person associated with the color of the target may be awarded a point. If a properly colored target remains deployed for threshold period of time (e.g., 2 or 2.5 seconds), then the target paddle may be moved into the retracted position and a point may be deducted from the associated user's total. A highest score or scores may be presented on a display.

Finally, a third target training game may be a timed shooting gallery game. In accordance with the timed shooting gallery game, the processor 305 may instruct the processors 355 of the various target pod devices 350 to move each respective target paddle into deployed positions. The processor 305 may start a timer and, for example, instruct a speaker of the target base to provide a sound indicating the start of the timer. A user is expected to shoot all the targets as quickly as possible. When the processor 305 determines, via communications provided by the target pod devices, that all, or a threshold number, of the targets have been hit, then the timer may be stopped and the duration of time may be presented on a display. A shortest time to complete the timed shooting gallery game may be presented on the display.

As used herein, the term "module" is intended to include a computer-related entity, such as but not limited to hardware, firmware, or a combination of hardware and software. For example, a module may be, but is not limited to being a software or hardware implementation of a process, an object, an executable, and/or a thread of execution, which may be implemented via a processor or computer. By way of example, both an application running on a computing device and/or the computing device can be a module. One or more modules can reside within a process and/or thread of execution and a module may be localized on one computer and/or distributed between two or more computers. In addition, these modules can execute from various computer readable media having various data structures stored thereon. The modules may communicate by way of local and/or remote processes such as in accordance with a signal having one or more data packets, such as data from one module interacting with another module in a local system, distributed system, and/or across a network such as the Internet with other systems by way of the signal. Each respective module may perform one or more functions that will be described in greater detail herein. However, it should be appreciated that although this example is described in terms of separate modules corresponding to various functions performed, some examples need not necessarily utilize modular architectures for employment of the respective different functions. Thus, for example, code may be shared between different modules, or the processing circuitry itself may be configured to perform all of the functions described as being associated with the modules described herein. Furthermore, in the context of this disclosure, the term "module" should not be understood as a nonce word to identify any generic means for performing functionalities of the respective modules. Instead, the term "module" should be understood to be a modular entity that is specifically configured in, or can be operably coupled to, processing circuitry to modify the behavior and/or capability of the processing circuitry based on the hardware and/or software that is added to or otherwise operably coupled to the processing circuitry to configure the processing circuitry accordingly.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A target training system comprising:

a target base; and a plurality of target pod devices;

wherein the target base comprises:

a frame;

a shroud, the shroud being supported by the frame and the shroud including attachment positions for removably attaching each of the target pod devices to the target base;

a target base processor configured to implement a target training game that controls operation of the target pod devices;

a target base communications interface configured to support communications between the target base processor and each of the target pod devices;

wherein each of the target pod devices comprises:

a pod base;

a hinge;

a target paddle, the target paddle being operably coupled to the pod base by the hinge, the target paddle being configured to swivel between a deployed position and a retracted position;

a rotary actuator operably coupled to the target paddle, the rotary actuator being configured to receive an actuator signal and, based on the actuator signal, rotate the target paddle to the deployed position or the retracted position;

a sensor configured to detect that the target paddle has moved towards the retracted position and provide a sensor signal indicating whether the target paddle has moved toward the retracted position;

a target pod processor configured to:

transmit the actuator signal to the rotary actuator to cause the rotary actuator to rotate the target paddle into the deployed position based on the target training game; and determine, based on the sensor signal, whether the target paddle has been moved toward the retracted position by a projectile; and a target pod communications interface configured to support communications between the target pod processor and the target base.

2. The target training system of claim 1, wherein the target base communications interface is further configured to support communications with the target pod devices via wireless communications; and wherein the target pod communications interface, for each target pod device, is configured to support communications with the target base via wireless communications.

3. The target training system of claim 1, wherein the target base further comprises a display operably connected to the target base processor, and wherein the target base processor is configured to direct the display to present target training game information based on the target training game and communications received from the target pod devices.

4. The target training system of claim 1, wherein the sensor is an accelerometer.

5. The target training system of claim 1, wherein each of the target pod devices further comprises a light emitter and wherein the light emitter is configured to emit one of a plurality of colors based on the target training game.

6. The target training system of claim 1, wherein, for each of the target pod devices, the target pod processor is further configured to analyze the sensor signal and generate a hit indication signal in response to the sensor signal indicating that the target paddle has moved toward the retracted position by the projectile.

7. The target training system of claim 1, wherein, for each of the target pod devices, the target pod processor is further configured to:

start a timer;

generate a no hit indication signal in response to the timer surpassing a threshold duration and the sensor signal indicating that the target paddle has remained in the deployed position.

8. The target training system of claim 1, wherein for each of the target pod devices, the target pod processor is further configured to, in response to determining, based on the sensor signal, that the target paddle has been moved toward the retracted position by the projectile, transmit the actuator signal to the rotary actuator to cause the rotary actuator to rotate the target paddle into the retracted position.

9. The target training system of claim 1, wherein the target base further comprises a user interface operably connected to the target base processor; and wherein the target base processor is further configured to determine the target training game based on user input provided via the user interface.

10. The target training system of claim 1, wherein the target base processor is further configured to aggregate hit data received from each of the target pod devices; and generate a score based on the aggregated hit data, wherein the hit data indicates that the target paddle for a respective target pod device has been moved toward the retracted position by a projectile.

11. The target training system of claim 10, wherein the target base further comprises a display operably connected to the target base processor, and wherein the target base processor is configured to direct the display to present the score.

12. The target training system of claim 1, wherein the target base processor is further configured to start a timer;

aggregate hit data received from each of the target pod devices; and determine a duration of time, based on the timer, that transpired before a threshold number of target pod devices detected that a projectile moved the respective target paddles toward the retracted position.

13. The target training system of claim 1, wherein the target base processor is further configured to control operation of a first target pod device within the plurality of target pod devices based hit data received from a second target pod device within the plurality of target pod devices, wherein the hit data indicates that the target paddle for a respective target pod device has been moved toward the retracted position by a projectile.

14. The target training system of claim 1, wherein the target base further comprises a battery charger and the target pod device further compromises a battery; and wherein the battery of the target pod device is operably connected to the battery charger of target base to charge the battery in response to the target pod device being installed in one of the attachment positions of the target base.

* * * * *